US005170958A

United States Patent [19]

Brown

[11] Patent Number: 5,170,958

[45] Date of Patent: Dec. 15, 1992

[54] TOILET PAPER DISPENSER

[76] Inventor: Earl C. Brown, 115-53 173rd St., St. Alban's, N.Y. 11434

[21] Appl. No.: 411,698

[22] Filed: Sep. 25, 1989

[51] Int. Cl.[5] ..... B65H 19/00

[52] U.S. Cl. ..... 242/55.53; 242/55.2; 242/75; 312/34.8

[58] Field of Search ..... 242/55.2, 55.3, 55.53, 242/75.2, 75; 220/18; 221/45, 283; 312/39, 245; 225/34, 38, 45, 47, 43, 49, 77, 80

[56] References Cited

U.S. PATENT DOCUMENTS

| | | | |
|---|---|---|---|
| 2,606,724 | 8/1952 | Hertz | 312/39 X |
| 2,805,112 | 9/1957 | Krueger | 312/39 X |
| 2,872,263 | 2/1959 | Andersson | 225/80 |
| 3,259,287 | 7/1966 | Spiker | 312/39 X |
| 3,760,976 | 9/1973 | Andreacchio | 242/55.53 |
| 4,179,078 | 12/1979 | Mansfield | 242/55.53 |
| 4,191,317 | 3/1980 | Harkins | 225/77 |
| 4,467,974 | 8/1984 | Crim | 242/75.2 X |
| 4,846,415 | 7/1989 | Jernberg et al. | 242/55.53 |

*Primary Examiner*—Stuart S. Levy
*Assistant Examiner*—Joseph A. Phoa
*Attorney, Agent, or Firm*—Darby & Darby

[57] ABSTRACT

A toilet paper housing for covering a roll of toilet paper suspended from a wall mounted holder is provided. The toilet paper housing dispenses paper and protects the roll of paper from interference by children or household pets. The housing is adapted to fit over the roll of toilet paper and has a slot for dispensing the roll of toilet paper therethrough and means for removably securing the guard to the wall so that the roll of toilet paper can be replaced in the holder.

4 Claims, 2 Drawing Sheets

TOILET PAPER DISPENSER

FIELD OF THE INVENTION

This invention relates generally to a toilet paper dispenser and, more particular, to a toilet paper dispenser provided for the purpose of covering, protecting, and dispensing a roll of wall mounted toilet paper.

BACKGROUND OF THE INVENTION

Toilet paper rolls are a common necessary bathroom feature. Toilet paper rolls are subject to becoming unrolled, for example, by small children or household animals.

Many types of dispensing apparatus are known in the art. None, however are directed to the type disclosed herein.

U.S. Pat. No. 4,453,649 issued to Origuchi shows use of a material placed over an opening through which a sheet material is dispensed. Origuchi shows a construction for containing and dispensing plastic film which is dispensed through a polyolefin cover film provided on the inside of a takeout opening.

Tensioning of the sheet material during dispensing is also known and is shown in U.S. Pat. No. 2,668,022 issued to Fairfield. Fairfield is directed to a sheet material dispenser having a lip that acts to restrain undesirable unwinding of the sheet material due to tensioning by a spring. U.S. Pat. No. 2,798,597 issued to Thompson is directed to a gauze holder having a friction means such as an adhesive provided on guide flanges through which the gauze passes in order to prevent accidental unreeling. U.S. Pat. No. 2,936,937 issued to Guyer is directed to a dispensing carton wherein tension against the material being dispensed is provided by a top panel. U.S. Pat. No. 4,034,929 issued to Ebner, Jr. is directed to an input cassette for dispensing film including a fabric like material which is useful as an opening restriction means.

U.S. Pat. No. 3,986,479 issued to Bonk discloses dispensing of a material through a constricted opening and is directed to a pre-moistened towelette dispenser which dispenses towelettes through feed slot adaptations in the lid of a box. U.S. Pat. No. 4,219,129 issued to Sedgwick is directed to a moist tissue dispenser which dispenses tissues through a constricted orifice. U.S. Pat. Nos. 4,244,493 issued to Harrison and 4,262,816 issued to Margolies each disclose dispensers for pre-moistened towelettes and show a constricting dispensing plate.

Cutting edges spaced from a dispensing opening are also known in the art. U.S. Pat. No. 2,850,157 issued to Klein et al. shows a dispenser for sheet material and a cutter which is spaced from flaps through which the sheet material is dispensed. U.S. Pat. No. 3,477,624 issued to Branyan et al. shows a blade which is spaced from an opening through which a web material is dispensed.

None of these patents teach or suggest a wall mounted reusable toilet paper holder for covering, protecting, dispensing and cutting sheets of paper from a roll of toilet paper mounted within the holder.

It is, therefore, an object of the invention to provide a wall mounted reusable toilet paper holder for covering, protecting, dispensing, and cutting sheets of paper from a roll of paper mounted within the holder.

Another object of the invention is to provide a toilet paper holder having a slot for dispensing the paper and a means for tensioning the paper through the slot.

A further object of the invention is to provide a toilet paper holder having a cutting edge spaced from the dispensing slot.

SUMMARY OF THE INVENTION

In accordance with the invention, a reusable wall mounted toilet paper holder for covering, protecting, dispensing, and cutting a roll of toilet paper is provided. The toilet paper holder fits over a roll of toilet paper and has a housing with an open side and an open interior. A slot is provided in the housing for dispensing the toilet paper and in a preferred embodiment, a vellum sheet having a slit is placed over the slot on the inner surface of the housing. The toilet paper passes through the slit in the vellum sheet. Additionally, in another preferred embodiment, a cutting edge is placed forward of the slot on the outside of the housing so that after cutting by the cutting edge, a portion of toilet paper remains extending through the slot and outside of the housing.

DESCRIPTION OF THE DRAWINGS

The foregoing and other features of the present invention will be more readily apparent from the following detailed description and drawings of illustrative embodiments of the invention in which.

DESCRIPTION OF THE PREFERRED EMBODIMENTS

Figure 1:
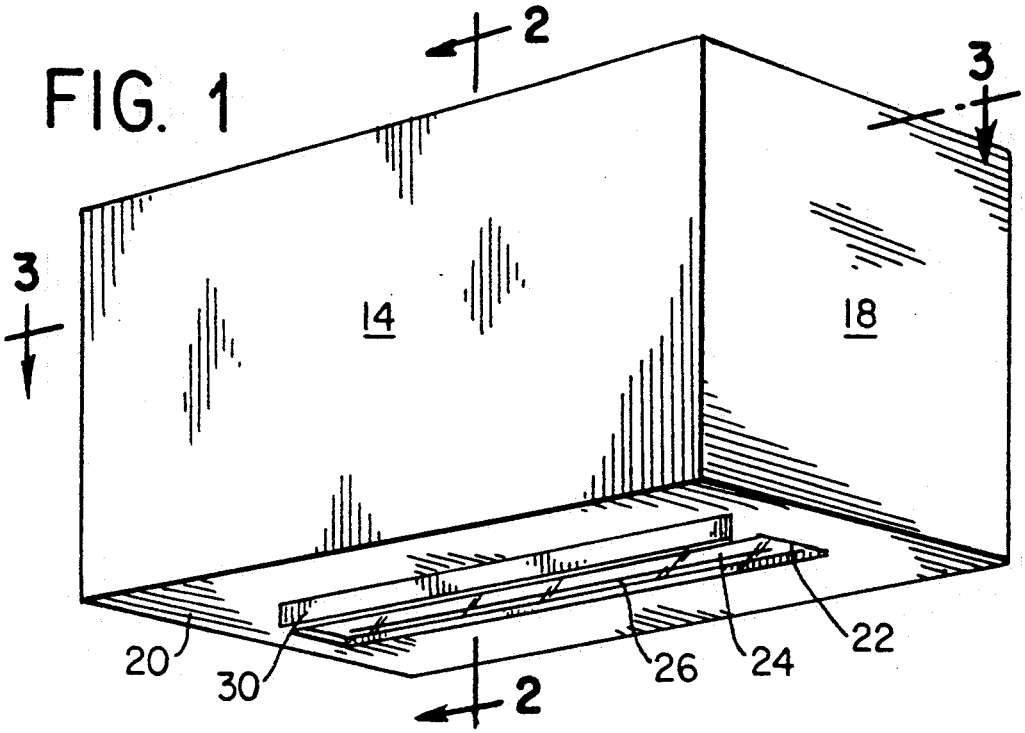
FIG. 1 is a perspective view of a toilet paper housing.

Toilet paper housing 10 is shown in FIG. 1 for covering a roll of toilet paper R secured to a wall W. Housing 10 has a back which is open and which faces wall W. Housing 10 is placed over a roll of toilet paper which is also mounted to wall W. Although it is desirable to provide only one open side so that the roll of toilet paper may be completely covered, an additional open wall may be provided.

The housing 10 may be of any size or shape suitable for covering a roll of toilet paper. In some applications, housing 10 may be used to cover a partially recessed roll of toilet paper and accordingly, the depth of the holder can then be reduced.

Housing 10 which is shown in FIG. 1 as having a rectangular box like shape includes front wall 14, bottom 20, top 16, and side walls 18.

Although the preferred embodiment of the invention includes a substantially box-like housing 10 having discrete edges and corners, it is to be understood that housing 10 may also have continuously curved surfaces and edges. Specifically, such a housing may be desirable in an environment where small children are present.

Housing 10 is formed of a substantially rigid material so as to maintain its shape upon the application of a force needed to cut or tear the paper as well as form a housing. Suitable substantially rigid materials include, but are not limited to, heavy cardboard, plastics such as poplypropylene, wood or wood-finished veneer, particle board and the like.

Slot 22 is preferably provided through bottom wall 20 for the purpose of dispensing toilet paper. In an alternate embodiment, housing 10 may be provided without a bottom wall, thereby forming an enlarged opening for dispensing toilet paper.

Vellum strip 24 is mounted on the inside wall of bottom 20. Slit 26 which is cut within vellum strip 24 is aligned with slot 22 so that the sheet of toilet paper which passes through slit 26 does not come in contact with any of the edges of bottom 20 which form slot 22. Toilet paper will be dispensed through the slit 26 without coming into contact with the edges of slot 22 which will apply tension to it to prevent uncontrolled unravelling of the roll.

Figure 3:
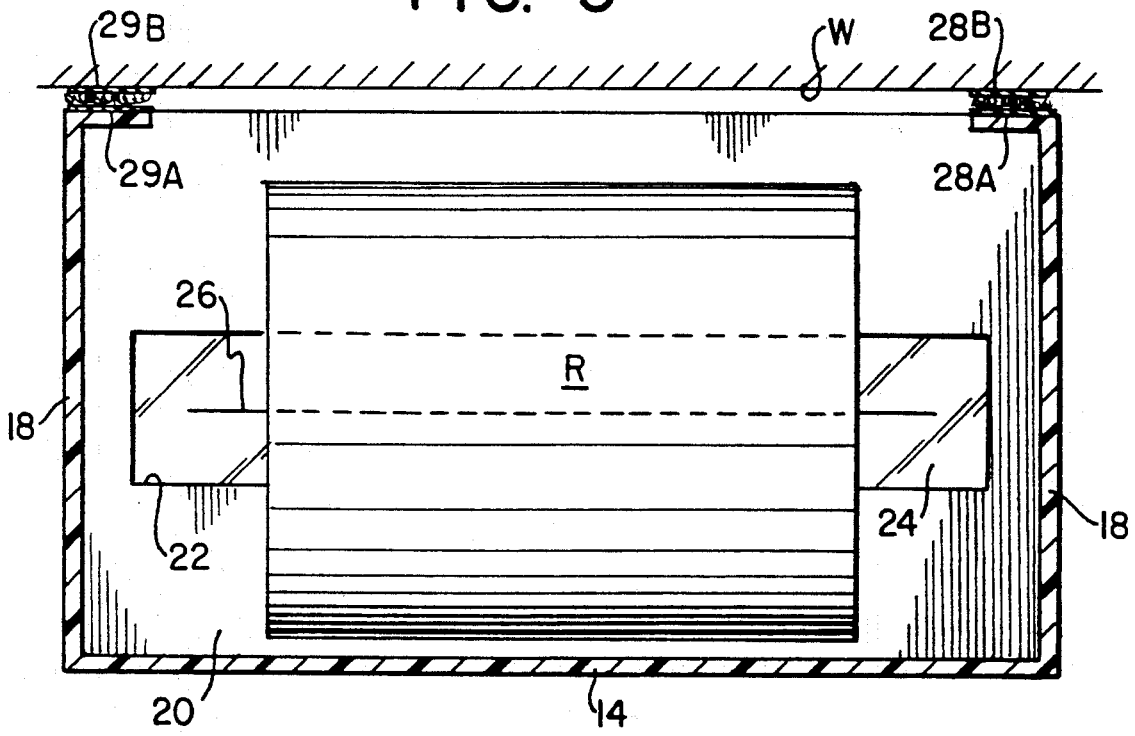
FIG. 3 is a cross-sectional view taken through section line 3—3 of FIG. 1.

Mounts 28A and 29A which are attached to housing 10 and shown in FIG. 3 are provided for removably securing the housing 10 to a wall along the open back face of the housing. In a preferred embodiment of the invention, mounts 28A, 29A are velcro strips which secure to corresponding velcro strip 28B, 29B which can be removably secured to the wall so that the toilet paper housing can be removed to gain access to the wall W from which toilet paper roll R is suspended.

Figure 2:
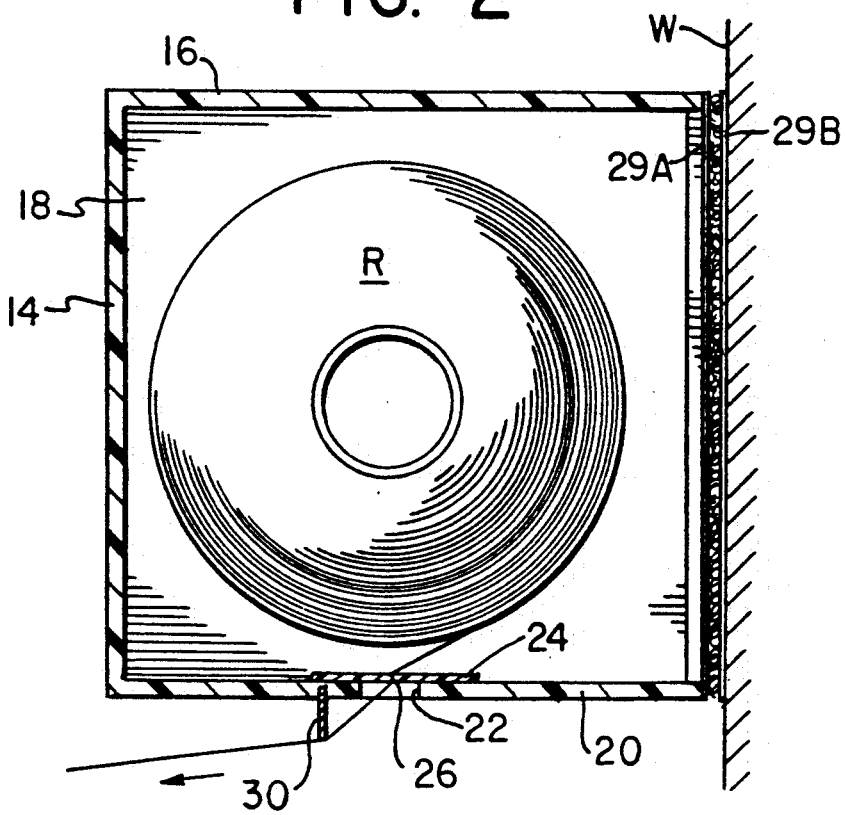
FIG. 2 is a cross-sectional view taken though section line 2—2 of FIG. 1.

Housing 10 is also preferably provided on its exterior with a cutting blade 30. Cutting blade 30 is preferably positioned on bottom 20 forward of slot 22 as in FIG. 2 so that the toilet paper can be cut or torn against it. After cutting of the paper against blade 30, a portion of toilet paper remains extending through slot 22 outside of housing 10 and which is thereby easily accessed.

Housing 10 is mounted to Wall W from which a roll of toilet paper is already secured in the following manner. Housing 10 is brought towards the roll of toilet paper and the free end of the roll is brought through the slit 26 in vellum strip 24. Once the toilet paper has been initiated through the slit 26, housing 10 is secured by housing mounts 28A, 29A wall mounts 28B, 29B.

The toilet paper housing is easily removed and replaced when necessary to replace the roll of toilet paper.

While the invention has been particularly shown and described with reference to preferred embodiments thereof, it will be understood by those skilled in the art that various changes in form and details may be made therein without departing from the spirit and scope of the invention.

What is claimed is:

1. A toilet paper guard for covering and dispensing paper from a roll of toilet paper suspended from a wall mounted holder, comprising:

a housing having an open interior for accommodating at least a portion of the roll of toilet paper therein, said housing having a wall with a slot for dispensing the toilet paper therethrough, said wall having an inside face which defines a portion of said open interior, said housing also having an open side in communication with said open interior;

means for removably securing the open side to the wall; and means for tensioning the toilet paper, said tensioning means including strip material secured to and extending in contact against said inside face, said strip material having a slit in alignment with said slot through said wall for enabling dispensement of the toilet paper from the roll through said slit and through said slot, said strip material being thereby arranged so that the toilet paper contacts the strip material only at said slit during the dispensement of the toilet paper.

2. The toilet paper guard of claim 11, wherein the material is a vellum sheet.

3. The toilet paper guard of claim 1, further including a cutting blade affixed to the housing along the exterior thereof.

4. The toilet paper guard of claim 1, wherein the securing means is a first Velcro strip permanently attached to the housing and a second Velcro strip attachable to the wall for securing the housing to the wall.

* * * * *